US007600481B2

(12) United States Patent
Fujita

(10) Patent No.: US 7,600,481 B2
(45) Date of Patent: Oct. 13, 2009

(54) UPPER LOOPER DRIVING DEVICE OF SEWING MACHINE

(75) Inventor: Shuuji Fujita, Tokyo (JP)

(73) Assignee: Juki Corporation, Tokyo (JP)

( * ) Notice: Subject to any disclaimer, the term of this patent is extended or adjusted under 35 U.S.C. 154(b) by 0 days.

(21) Appl. No.: 12/035,768

(22) Filed: Feb. 22, 2008

(65) Prior Publication Data

US 2008/0202400 A1 Aug. 28, 2008

(30) Foreign Application Priority Data

Feb. 23, 2007 (JP) ..... 2007-043773

(51) Int. Cl.
*D05B 57/34* (2006.01)
*D05B 57/00* (2006.01)

(52) U.S. Cl. ..... 112/199; 112/220

(58) Field of Classification Search ..... 112/197–200, 112/220, 284

See application file for complete search history.

(56) References Cited

U.S. PATENT DOCUMENTS 3,465,701 A * 9/1969 Walling ..... 112/245
3,670,677 A * 6/1972 Hirayama ..... 112/199
3,881,434 A * 5/1975 Kelly ..... 112/162
4,690,080 A * 9/1987 Mikuni et al. ..... 112/162
5,237,942 A * 8/1993 Satoma ..... 112/162
5,301,622 A * 4/1994 Sakuma ..... 112/162
5,664,509 A * 9/1997 Tseng ..... 112/200
7,458,326 B2 * 12/2008 Yamaguchi et al. ..... 112/200

FOREIGN PATENT DOCUMENTS

JP 2006-141548 6/2006

* cited by examiner

*Primary Examiner*—Ismael Izaguirre
(74) *Attorney, Agent, or Firm*—Drinker Biddle & Reath LLP

(57) ABSTRACT

An upper looper driving device of a sewing machine is provided. The device includes an upper looper driving shaft which is rotatable around an axis thereof, an upper looper holder having an upper end portion at which the upper looper is held, an upper looper swinging arm having one end portion supported by the upper looper driving shaft such that a position of the upper looper swinging arm is adjustable along an axial direction of the upper looper driving shaft and the other end portion to which the upper looper holder is rotatably coupled, and an upper looper guide slidably holding the upper looper holder. The upper looper guide is supported by a frame of the sewing machine such that a position of the upper looper guide is adjustable along a direction parallel to the axial direction of the upper looper driving shaft.

4 Claims, 8 Drawing Sheets

UPPER LOOPER DRIVING DEVICE OF SEWING MACHINE

CROSS-REFERENCE TO RELATED APPLICATION(S)

The present application claims priority from Japanese Patent Application No. 2007-043773 filed on Feb. 23, 2007, the entire content of which is incorporated herein by reference.

FIELD OF THE INVENTION

Apparatuses consistent with the present invention relate to an upper looper driving device of a sewing machine.

DESCRIPTION OF THE RELATED ART

Related art overlook sewing machines include a needle, a lower looper and an upper looper. The upper looper passes through a side of the lower looper to insert an upper looper thread through a loop of a lower looper thread, and a tip portion of the upper looper moves toward a stitch point of the needle to insert the needle and the needle thread into a loop of the upper looper thread, whereby an overlock stitch is formed.

More specifically, when seen from a front side of the sewing machine, the lower looper moves so as to pass through a rear side of a moving path of the needle, and the upper looper moves so to pass through a rear side of a moving path of the lower looper and through a front side of the moving path of the needle.

In order to implement such a stitching work, some related art sewing machines are configured such that the needle reciprocates in an oblique direction with respect to a vertical direction. However, in such a configuration, there have been some disadvantages, e.g., a cloth might be shifted from a proper mounting position upon receipt of a horizontal component of a motion of the needle when the needle penetrates through the cloth, or the needle might break by being stuck on the cloth.

In order to solve such problems, there has been proposed an upper looper driving device operable to implement the above-described stitching work while moving the needle in the vertical direction (see, e.g., JP 2006-141548 A).

FIG. 8 shows an upper looper driving device 100 of a sewing machine in which a needle moves a vertical direction. The upper looper driving device 100 includes an upper looper driving shaft 101 which is rotated interlockingly with a sewing machine motor (not shown), an upper looper swinging arm 102 having one end coupled to the upper looper driving shaft 101 and the other end being swingable in accordance with a rotation of the upper looper driving shaft 101. The upper looper driving device 100 further includes an upper looper holding bar 104 holding an upper looper 103, and a coupling member 105 coupling the upper looper holding bar 104 and the other end of the upper looper swinging arm 102 such that the upper looper holding bar 104 is rotatable around two axes X1, X2. The upper looper driving device 100 further includes a support member 106 through which the upper looper holding bar 104 is inserted, and pin 107 holding the support member 106 such that the support member 106 is rotatable with respect to a bed portion of the sewing machine. The support member 106 is movable along an axial direction of the upper looper holding bar 104 and is rotatable around two axes X3, X4.

This upper looper driving device 100 allows the needle to move along a moving path 109 extending in the vertical direction while forming overlock stitches.

In order to perform an appropriate stitching work on case-by-case basis, a user has to adjust, before the stitching work an interval between the upper looper 103 and a lower looper 108 and an interval between the upper looper 103 and the needle. When adjusting the interval between the upper looper 103 and the lower looper 108, the upper looper swinging arm 102 is moved in the axial direction of the upper looper driving shaft 101, i.e., in a cloth feeding direction, whereby the upper looper 103 is moved in the same direction. However, when adjusting the interval between the upper looper 103 and the lower looper 108, the interval between the upper looper 103 and the needle changes at the same time. Therefore, the intervals between the upper looper 103, the lower looper 108 and the needle need to be adjusted in several steps. Thus, this related art upper looper driving device 100 has a disadvantage in that it requires a complicated and onerous adjusting work.

SUMMARY OF THE INVENTION

An exemplary embodiment of the present invention provides an upper looper driving device of a sewing machine in which a position of an upper looper with respect to a lower looper and a needle can be easily adjusted.

According to an aspect of the invention, an upper looper driving device of a sewing machine is provided. The upper looper driving device includes an upper looper driving shaft provided so as to be rotatable around an axis thereof, an upper looper holder having an upper end portion at which the upper looper is held, an upper looper swinging arm having one end portion supported by the upper looper driving shaft such that a position of the upper looper swinging arm with respect to the upper looper driving shaft is adjustable along an axial direction of the upper looper driving shaft and the other end portion to which the upper looper holder is rotatably coupled, and an upper looper guide holding an intermediate portion of the upper looper holder such that the upper looper holder is slidable with respect to the upper looper guide. The upper looper guide is supported by a frame of the sewing machine such that a position of the upper looper guide with respect to the frame is adjustable along a direction parallel to the axial direction of the upper looper driving shaft.

Other aspects and advantages of the present invention will be apparent from the following description, the drawings and the claims.

DETAILED DESCRIPTION

Hereinafter, an exemplary embodiment of the invention will be explained with reference to the drawings. The following exemplary embodiment does not limit the scope of the invention. A sewing machine 100 according to the exemplary embodiment is an overlock sewing machine.

[Structure of Sewing Machine]

Figure 1:
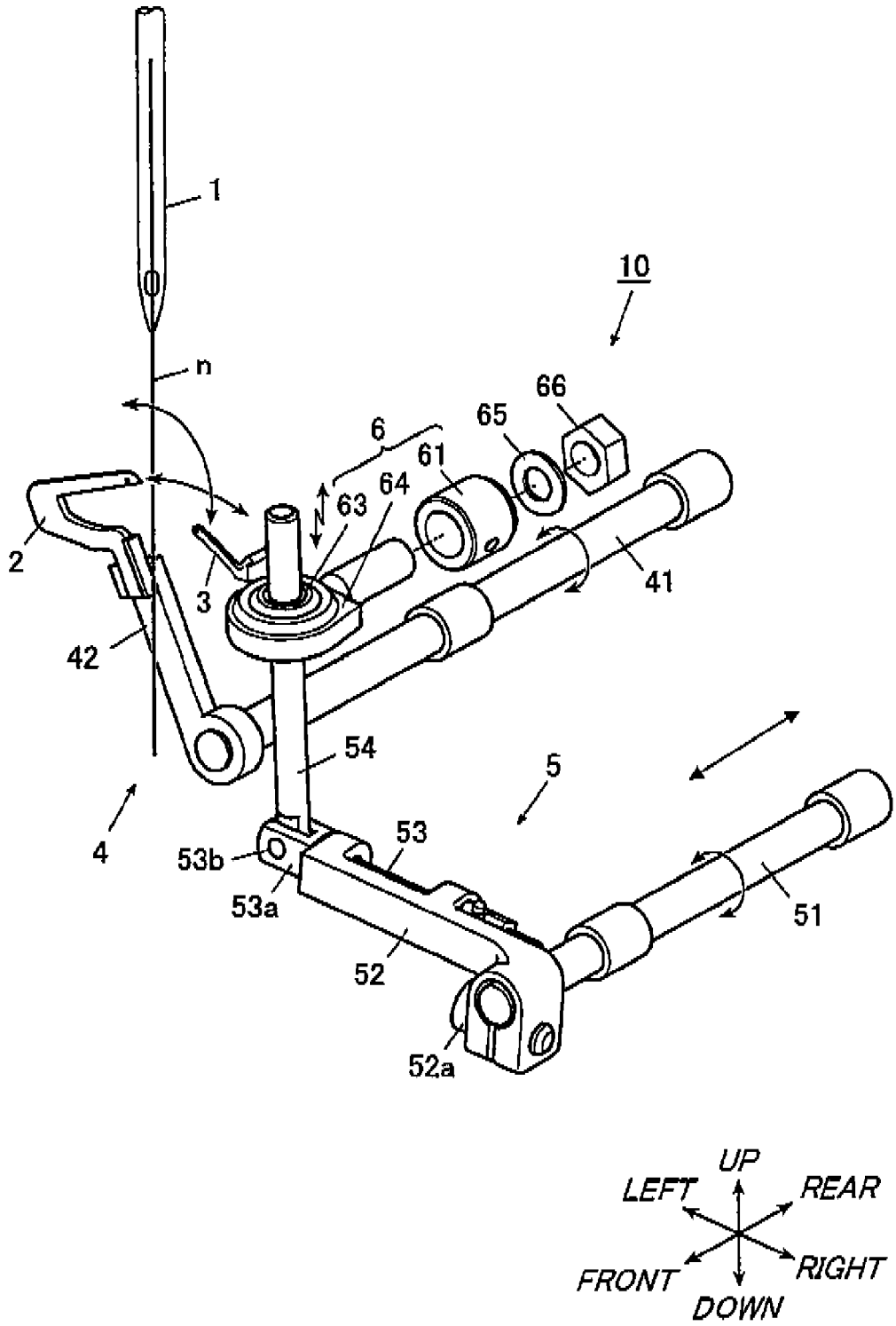
FIG. 1 is a perspective view showing an upper looper driving device and a lower looper driving device.

As shown in FIG. 1, the sewing machine 10 includes a needle 1 which moves in a vertical motions, a lower looper 2 which inserts a lower looper thread into a loop of a needle thread passing through the needle 1 below a cloth (a workpiece), and an upper looper 3 which inserts an upper looper thread into a loop of the lower looper thread.

The sewing machine 10 further includes a sewing machine motor, an upper shaft which is rotated by the sewing machine motor, and a needle bar coupled to the upper shaft. The needle 1 is provided on a lower end portion of the needle bar.

The sewing machine 10 further includes a bed portion B inside which the lower looper 2 and the upper looper 3 are accommodated below a throat plate.

The upper looper 3 passes through a rear side of a moving path of the lower looper 2 to insert the upper looper thread through the loop of the lower looper thread, and a tip portion of the upper looper 3 moves toward a stitch point of the needle 1 to insert the needle 1 and the needle thread through a loop of the upper looper thread. Overloack stitches are formed by repeating these movements. The sewing machine 10 further includes a lower looper driving device 4 operable to drive the lower looper 2, and an upper looper driving device 5 operable to drive the upper looper 3.

In the following description, an up-and-down direction is a vertical direction, and is coincident with a moving direction of the needle 1. A front-and-rear direction is coincident with a cloth feeding direction in which the cloth is fed in a sewing work, and is parallel to a horizontal plane and an upper surface of the throat plate. The cloth is fed in a rearward direction over the throat plate. A right-and-left direction is also parallel to the horizontal plane and the upper surface of the of the throat plate. The up-and-down direction, the front-and-rear direction, and the right-and-left direction are orthogonal to each other.

[Lower Looper Driving Device]

The lower looper driving device 4 is disposed inside the bed portion B. The lower looper driving device 4 includes a lower looper driving shaft 41 disposed so as to extend in the cloth feeding direction, i.e., in the front-and-rear direction as shown in FIG. 1, and a lower looper holding arm 42 fixed to a tip end portion of the lower looper driving shaft 41. The lower looper driving shaft 41 is rotatably supported by the bed portion B, and the lower looper holding arm 42 swings in accordance with the rotation of the lower looper driving shaft 41. The lower looper 2 is held by the lower looper holding arm 42 at a swinging end portion of the lower looper holding arm 42.

The lower looper driving shaft 41 is coupled to a transmitting mechanism (not shown) operable to convert the rotational force from the upper shaft into a reciprocating rotational force. Thus, the lower looper driving shaft 41 is oscillated synchronously with the upper shaft, whereby the lower looper holding arm 42 is swung.

According to this lower looper driving device 4, the lower looper 2 moves so as to pass through a rear side of a moving path n of the needle 1 below the throat plate, thereby catching the needle thread from the needle 1 when the needle 1 is at its lower position and inserting is the loop of the lower looper thread through the loop of the needle thread.

[Upper Looper Driving Device]

Figure 2:
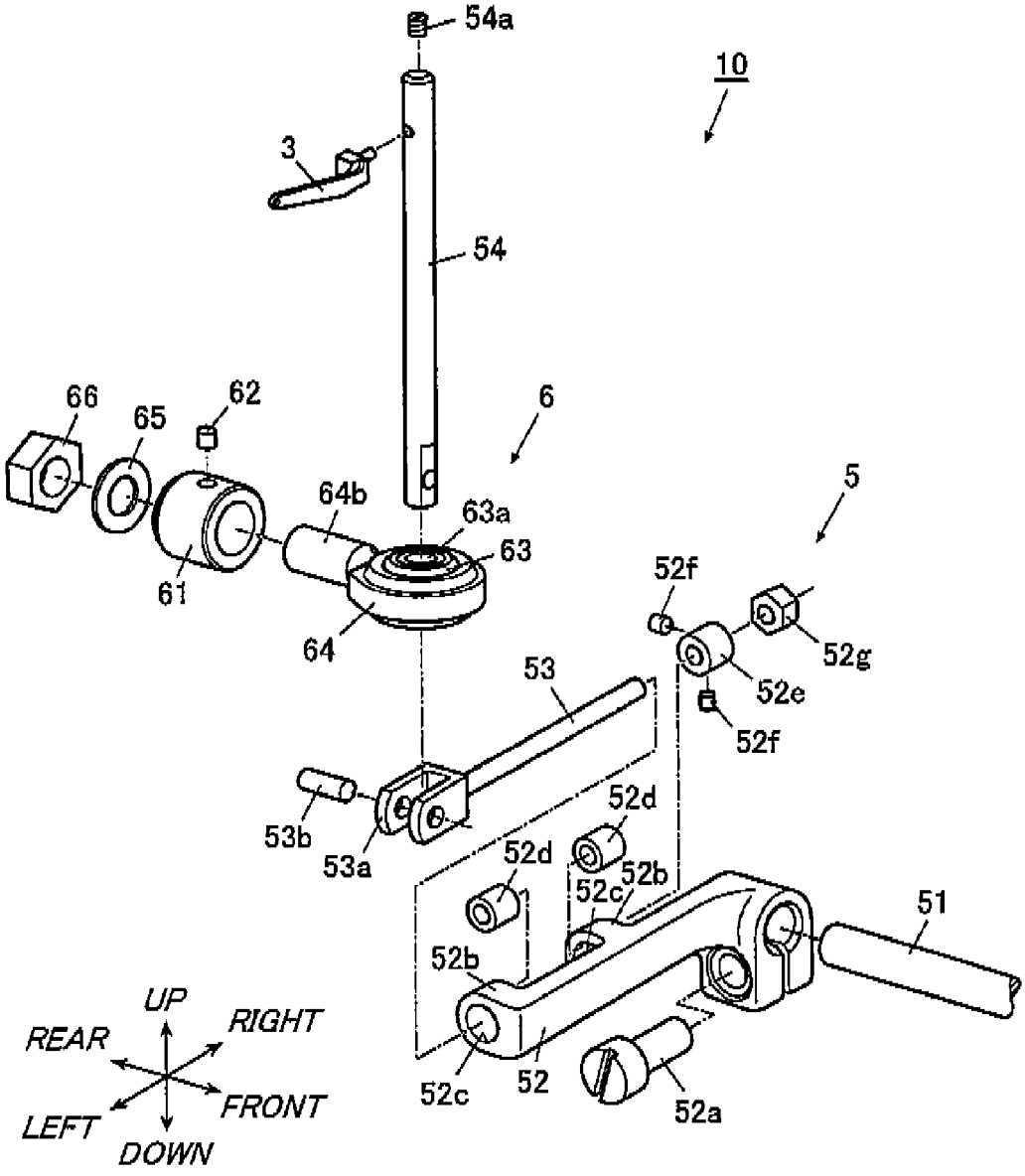
FIG. 2 is an exploded perspective view showing the upper looper driving device and an upper looper guide thereof.
Figure 3:
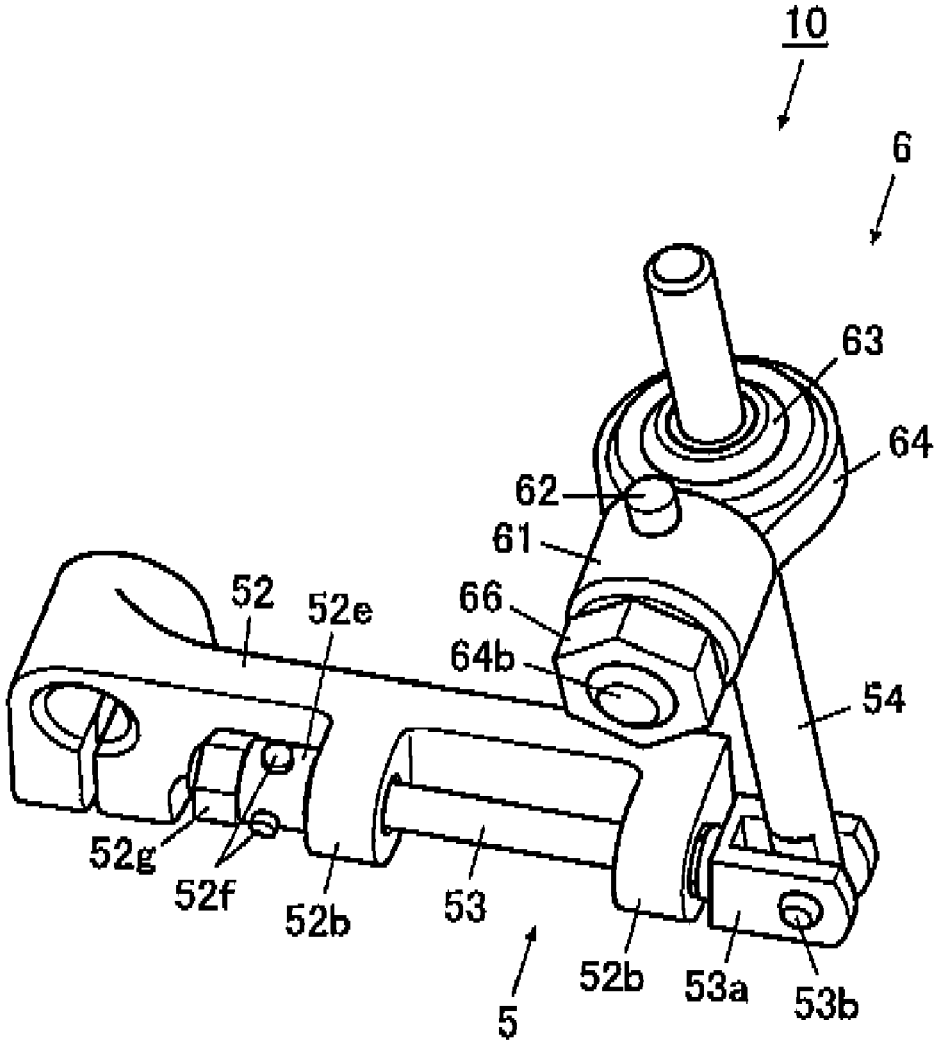
FIG. 3 is a perspective view of the upper looper driving device.

The upper looper driving device 5 is disposed inside the bed portion B. As shown in FIGS. 1 and 2, the upper looper driving device 5 includes an upper looper driving shaft 51 extending in the cloth feeding direction, i.e., in the front-and-rear direction. The upper looper driving shaft 51 is rotatably supported by the bed portion B. A rear end portion of the upper looper driving shaft 51 is coupled to a driving source (not shown) such as a motor, and is oscillated around an axis thereof interlockingly with the driving source.

The upper looper driving device 5 further includes an upper looper swinging arm 52 having one end coupled to a front end portion of the upper looper driving shaft 51, an upper looper slider lever 53 provided slidably on the upper looper swinging arm 52, and an upper looper holder 54 rotatably coupled to the upper looper slider lever 53 and having a cylindrical shape. The upper looper swinging arm 52 swings in accordance with the oscillation of the upper looper driving shaft 51. The upper looper 3 is fixed to an upper end portion of the upper looper holder 54, and the upper looper slider lever 53 moves the upper looper 3 in the right-and-left direction. The upper looper driving device 5 further includes an upper looper guide 6 through which the upper looper holder 54 is slidably held.

The upper looper driving device 5 will be described in more detail.

The upper looper driving shaft 51 is disposed along an axial direction of the lower looper driving shaft 41. The upper looper driving shaft 51 is coupled to a transmitting mechanism (not shown) operable to convert the rotational force from the upper shaft into the reciprocating rotational force. Thus, the upper looper driving shaft 51 is oscillated synchronously with the upper shaft. The upper looper swinging arm 52 is fixed to the upper looper driving shaft 51 with a fastening screw 52*a* such that the upper looper swinging arm 52 holds around the upper looper driving shaft 51. The upper looper swinging arm 52 is movable along the axial direction of the upper looper driving shaft 51 when the fastening screw 52*a* is loosened.

The upper looper swinging arm 52 includes a support portion 52*b* at the other end thereof and another support portion 52*b* at an intermediate portion thereof in its longitudinal direction for supporting the upper looper slider lever 53. Each of the support portions 52*b* is formed with an insertion hole 52*c* through which the upper looper slider lever 53 is inserted. More specifically, bearings 52*d* are inserted into the respective insertion holes 52*c*, and the upper looper slider lever 53 is rotatably supported through the bearings 52*d*.

A thrust collar 52*e*, through which the upper looper slider lever 53 is inserted, is attached to the upper looper slider lever 53 with setscrews 52*f*. A jam nut 52*g* is screwed onto one end of the upper looper slider lever 53 adjacently to the thrust collar 52*e*.

The upper looper slider lever 53 includes a coupler 53*a* at the other end thereof for rotatably coupling the upper looper holder 54 thereto. The upper looper holder 54 and the coupler 53*a* are coupled to each other by inserting a coupling pin 53*b* through the upper looper holder 54 and the coupler 53*a*.

The upper looper holder 54 is coupled to the upper looper slider lever 53 at one end portion thereof such that an angle formed by an axis of the upper looper holder 54 and an axis of the upper looper slider lever 53 changes when the upper looper holder 54 is rotated. The upper looper 3 is attached at the other end portion of the upper looper holder 54 with a setscrew 54*a*. The upper looper holder 54 is inserted through the upper looper guide 6, and is held by the upper looper guide 6.

[Upper Looper Guide]

The upper looper guide 6 is held by the bed portion B such that a position of the upper looper guide 6 is adjustable in the cloth feeding direction, i.e., in the front-and-rear direction as shown in FIG. 1.

As shown in FIGS. 1 to 5, the upper looper guide 6 includes a fixable bearing 61 inserted through the bed portion B (a frame of the sewing machine 10) such that a position of the fixable bearing 61 with respect to the bed portion B is adjustable in an axial direction thereof, a setscrew 62 (a fixing member) for fixing the fixable bearing 61 to the bed portion B, a spherical bearing 63 formed with an insertion hole 63*a* through which the upper looper holder 54 is inserted such that the upper looper holder 54 is slidable along a longitudinal direction thereof, and a holding portion 64 rotatably hold the spherical bearing 63. The holding portion 64 is rotatably supported by the fixable bearing 61.

The fixable bearing 61 has a cylindrical shape, and is inserted into the bed portion B, and is fixed to the bed portion B with the setscrew 62. When the fixable bearing 61 is not fixed with the setscrew 62, the fixable bearing 61 is movable in the axial direction thereof with respect to the bed portion B.

The spherical bearing 63 has a spherical shape, and a surface thereof slides with respect to the holding portion 64. The spherical bearing 63 is formed with the insertion hole 63*a* through which the upper looper holder 54 is inserted.

Figure 4A:
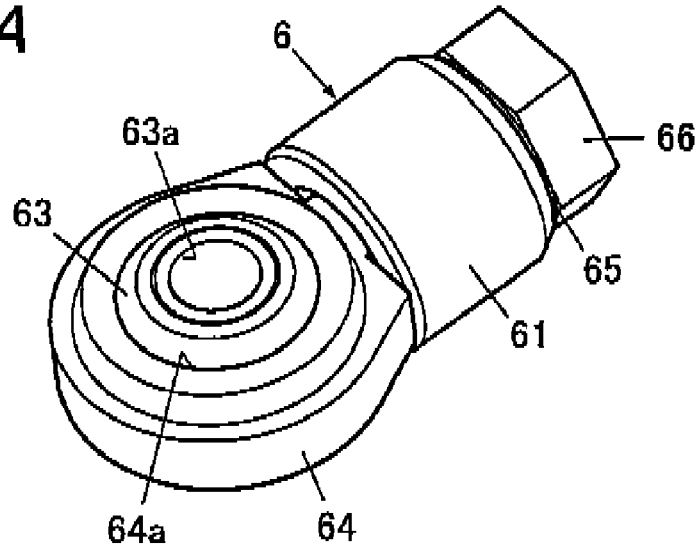
FIG. 4A is a perspective view of the upper looper guide.
Figure 4B:
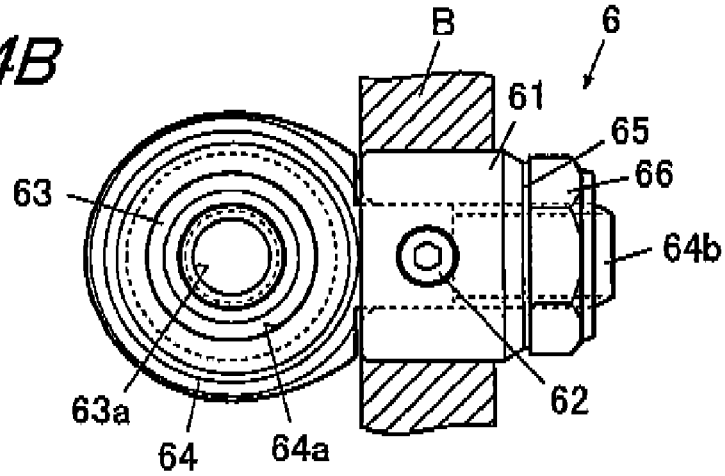
FIG. 4B is a plan view of the upper looper guide.
Figure 4C:
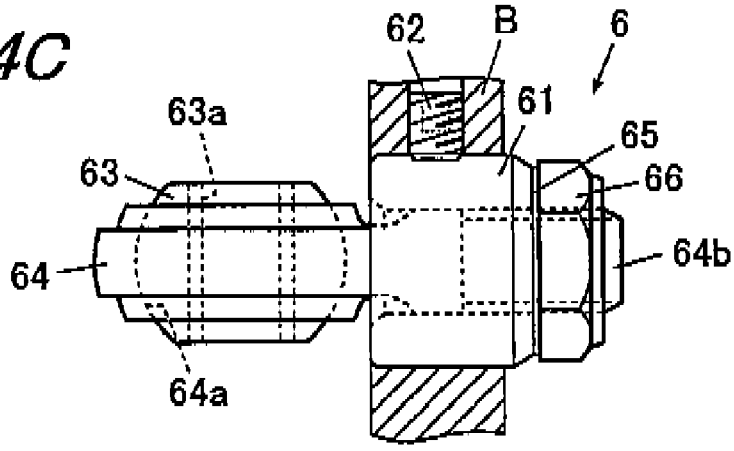
FIG. 4C is a side view of the upper looper guide.
Figure 5:
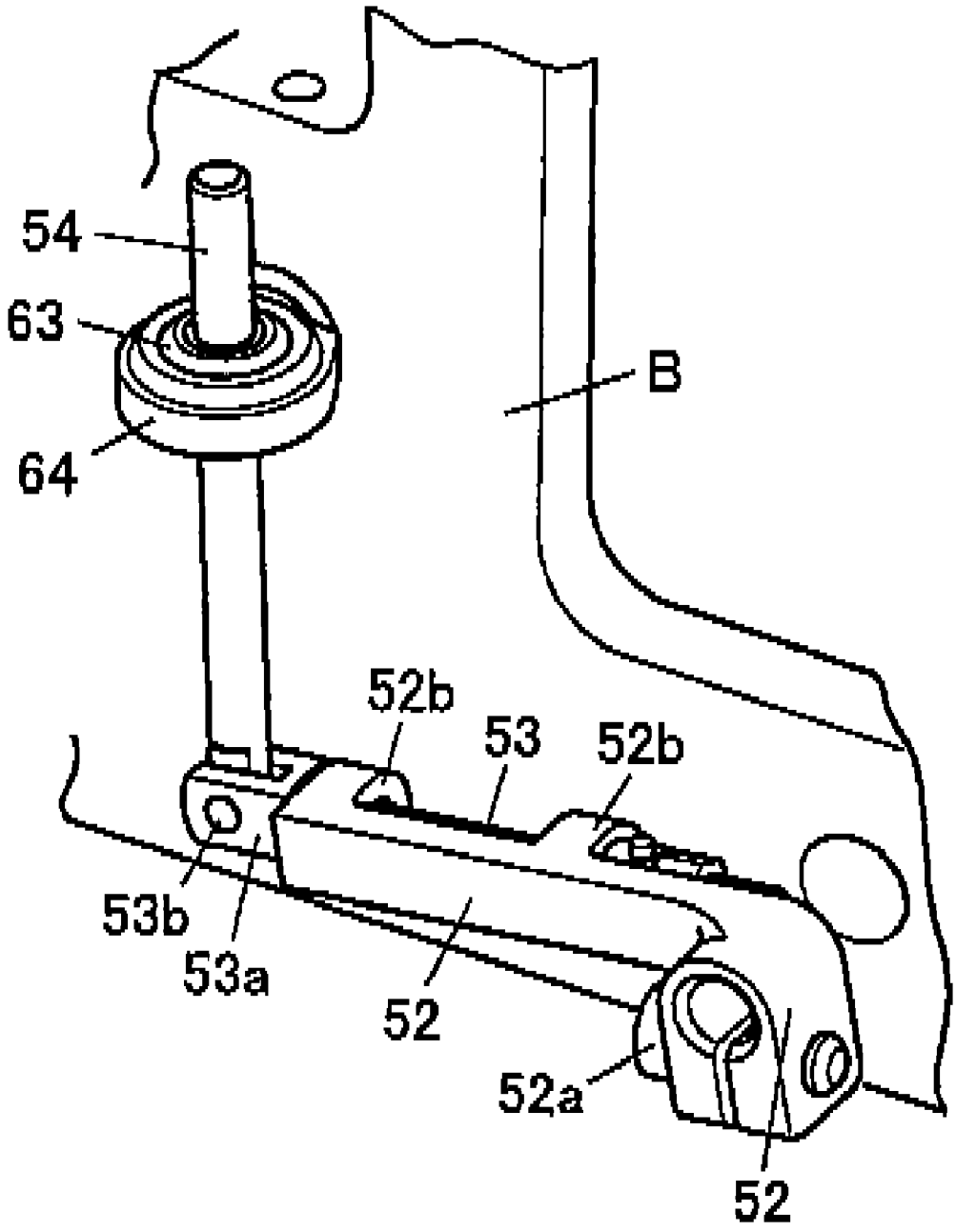
FIG. 5 is a perspective view showing the upper looper driving device attached to a bed portion of a sewing machine.

As shown in FIG. 4, the holding portion 64 is formed with a holding hole 64*a* inside which the spherical bearing 63 is rotatably held. The holding hole 64*a* is formed so as to penetrate from an upper surface of the holding portion 64 to a lower surface of the holding portion 64 so that the upper looper holder 54 is insertable therethrough.

The holding portion 64 includes a shaft portion 64*b* which is rotatable supported by the fixable bearing 61. A washer 65 and a nut 66 is provided on the shaft portion 64*b* on an opposite side of the holding hole 64*a* with respect to the fixable bearing 61 in order to prevent the holding portion 64 from slipping off form the fixable bearing 61 by the movement of the upper looper holder 54.

According to this upper looper driving device 5, the spherical bearing 63 allows the upper looper holder 54 to move in any directions.

[Operations of Upper Looper Driving Device]

Figure 6:
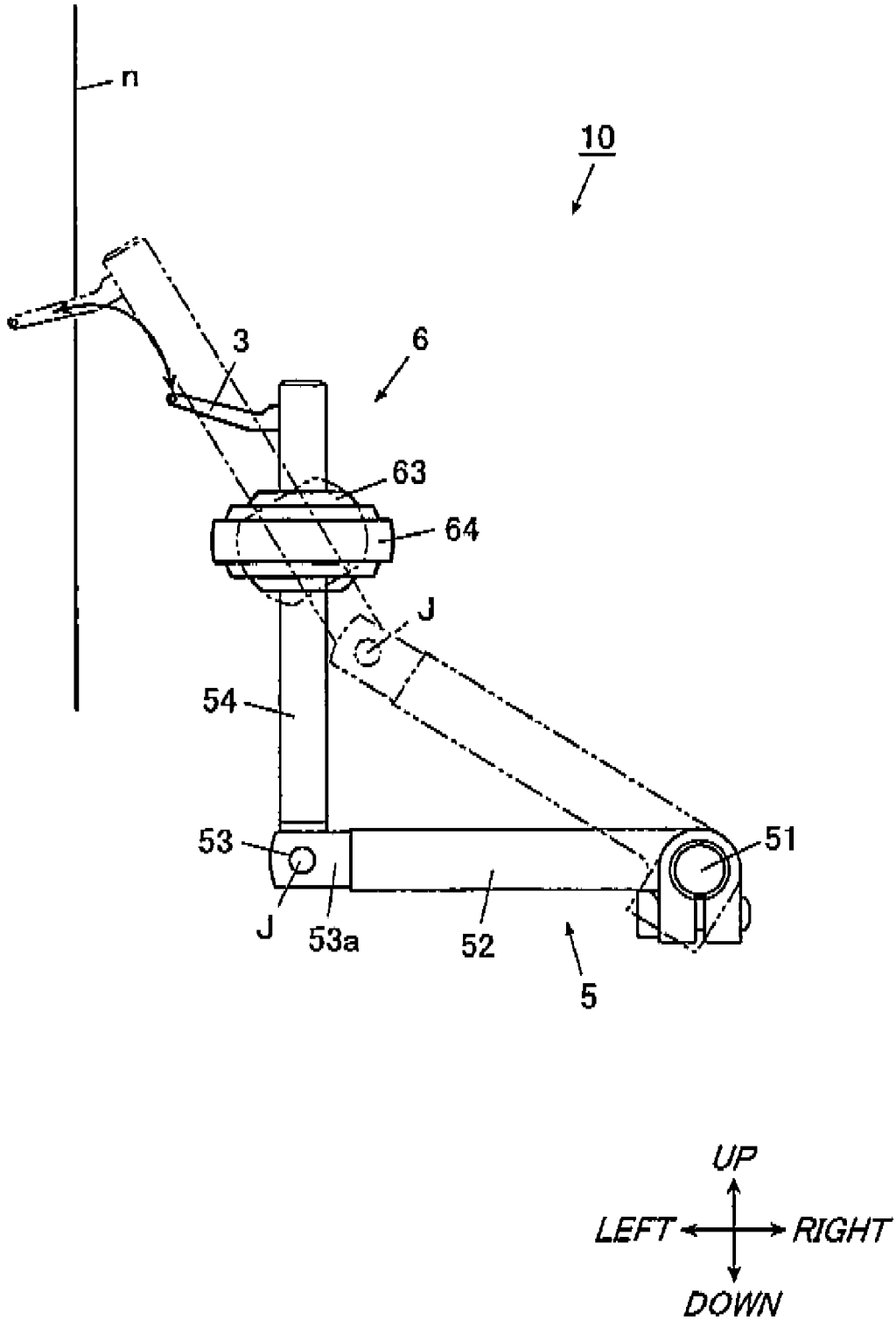
FIG. 6 is a front view showing the upper looper driving device.
Figure 7:
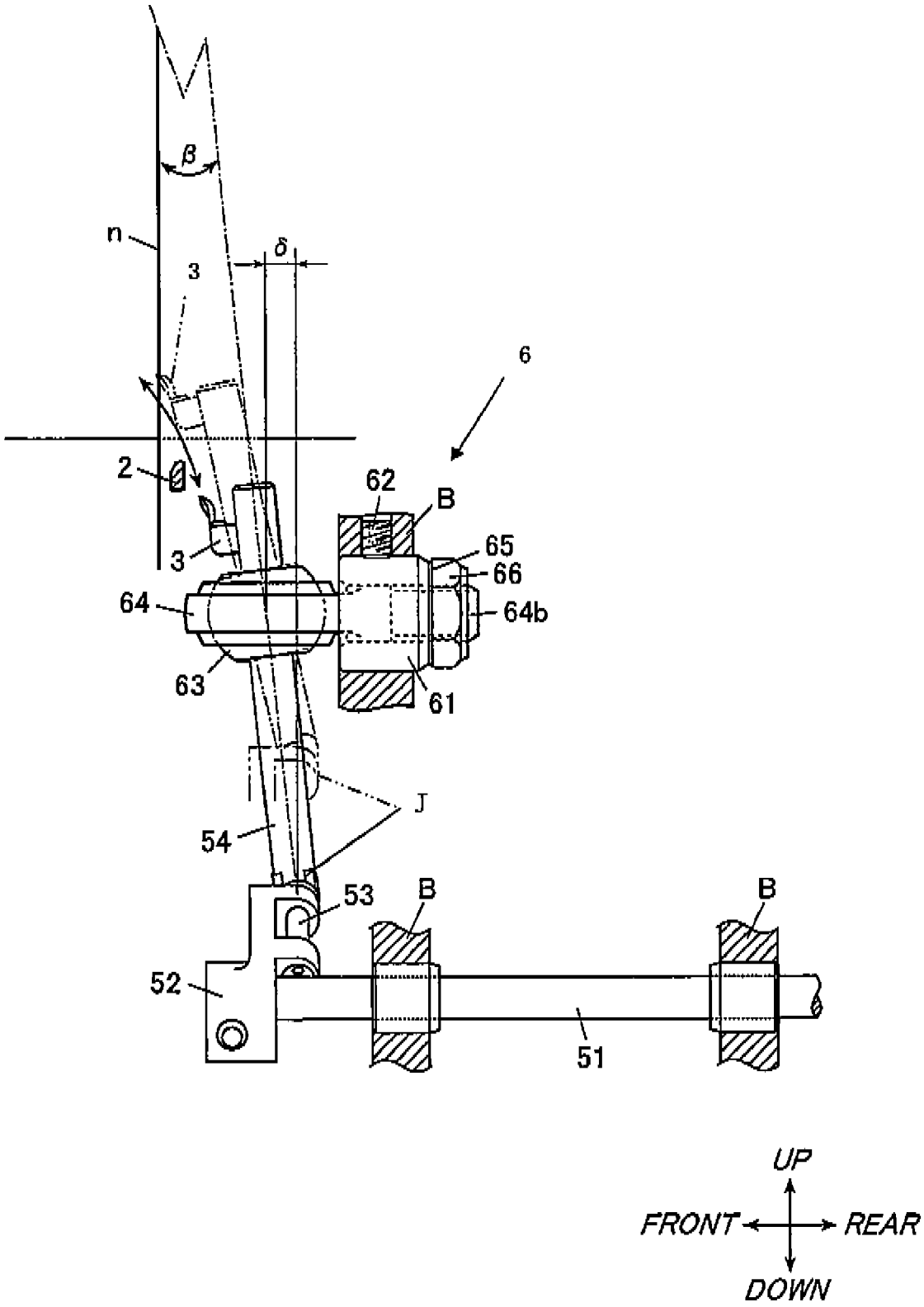
FIG. 7 is a side view showing the upper looper driving device.
Figure 8:
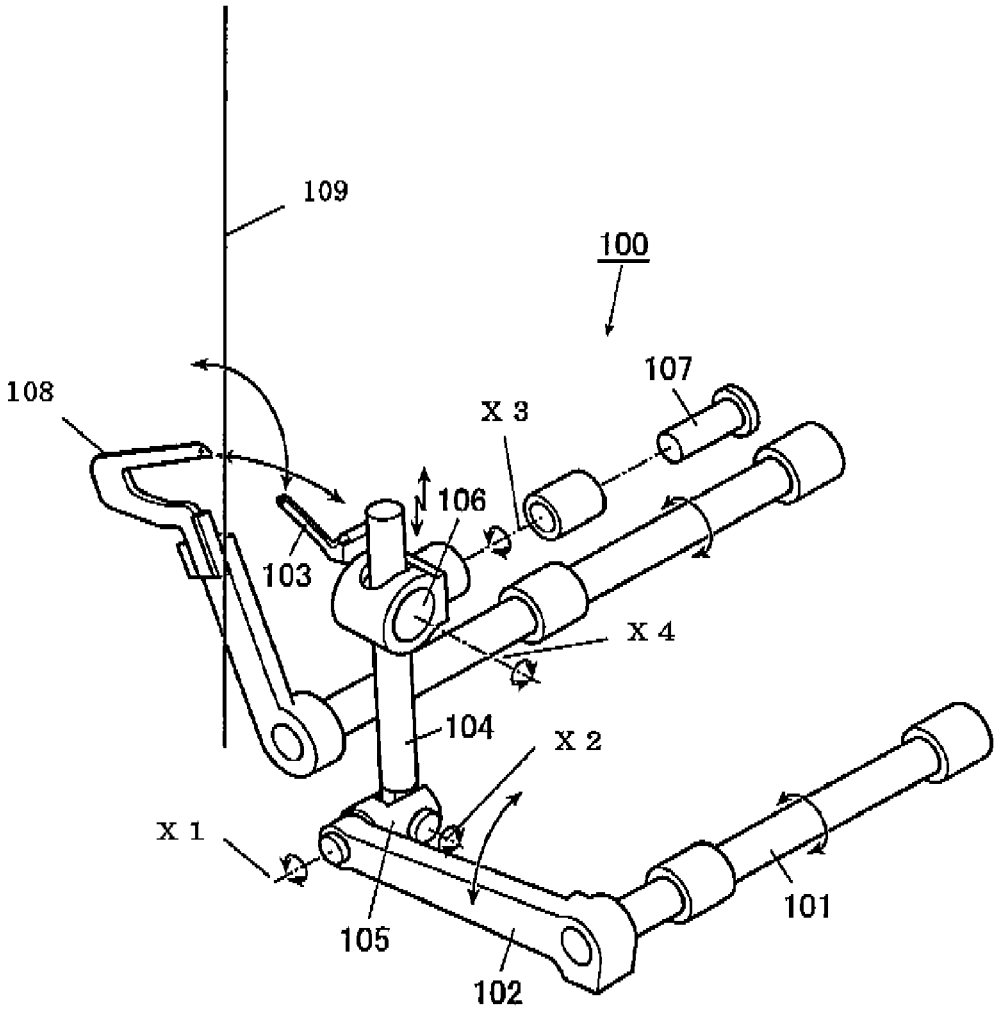
FIG. 8 is a perspective view showing an upper looper driving device and a lower looper driving device according to the related art.
Figure 8:
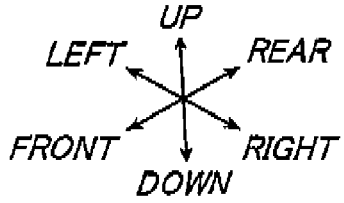

Operations of the upper looper driving device 5 will be described with reference to FIGS. 6 and 7, FIG. 6 is a front view showing the upper looper driving device 5, and FIG. 7 is a side view showing the upper looper deriving mechanism 5 from a right side thereof.

The upper looper driving shaft 51 is oscillated around its axis by a driving force transmitted from the sewing machine motor via the transmitting mechanism. When the upper looper driving shaft 51 is oscillated, the upper looper swinging arm 52 coupled to the upper looper driving shaft 51 rotates around a coupling point to the upper looper driving shaft 51, whereby a coupling point J of the upper looper swinging arm 52 and the upper looper holder 54 moves between two positions, which are shown by a solid line and a two-dotted chain line respectively in FIGS. 6 and 7.

When seen from a front side, as shown in FIG. 6, a position of the coupling point J changes in accordance with a moving path of an swinging end of the upper looper swinging arm 52. More specifically, when seen from the front side, the position of the coupling point J reciprocates between a position vertically below the upper looper guide 6 (hereinafter, "a first position") and a position rightwardly above the first position (hereinafter, "a second position").

Therefore, when the coupling point J is moved from the first position to the second position, in the front view, the upper looper holder 54 becomes tilted around the upper looper guide 6 from a state in which the upper looper holder 54 extends along the up-and-down direction, and an upper end thereof moves upward and toward the left. At the same time, the tip portion of the upper looper 3 moves from a position on a right side of the moving path n of the needle and reaches a position on a left side of the moving path n of the needle 1.

When seen from the right side, as shown in FIG. 7, the first position of the coupling point J is deviated by an amount δ toward a rear side of a position at which the upper looper holder 54 is held by the upper looper guide 6, and the upper looper holder 54 is tilted by an angle β with respect to the moving path n of the needle 1.

Therefore, when the coupling point J is moved from the first position to the second position due to the swinging movement of the upper looper swinging arm 52, in the right side view, the coupling point J moves in the up-and-down direction but not in the front-and-rear direction.

However, because the coupling point J moves upward while keeping the deviation amount δ with respect to the upper looper guide 6, the tilt angle β increases in accordance with the upward movement of the upper looper holder 54. Accordingly, when seen from the right side, the upper looper holder 54 becomes more tilted around the upper looper guide 6 so that the upper end thereof moves upward toward the front.

At the same time, the tip portion of the upper looper 3 moves from a position on the rear side of the moving path n of the needle 1 and reaches a position on the front side of the moving path n of the needle 1. In other words, because the tip portion of the upper looper 3 moves toward the left and toward the front during the upward movement of the tip portion of the upper looper 3, the upper looper 3 moves along a locus on a curved surface that cannot be plotted on a flat surface.

When adjusting an interval between the upper looper 3 and the needle 1 and an interval between the upper looper 3 and the lower looper 2 in the upper looper driving device 5, it is necessary to move the upper looper swinging arm 52 along the upper looper driving shaft 51. However, when the position of the upper looper swinging arm 52 with respect to the upper looper driving shaft 51 is changed, the position of the coupling point J also changes. Thus, the amount δ of deviation from the upper looper guide 6 also changes.

Due to the change of the deviation amount δ, a moving path of the upper looper holder 54, the interval between the needle 1 and the upper looper 3 at its upper dead point, and the interval between the lower looper 2 and the upper looper 3 at its lower dead point, are also changed. Accordingly, positions and timings at which the upper looper 3, the lower looper 2 and the needle 1 catch the loop of the corresponding thread change. As a result, the overlock stitching cannot be formed in some cases. With a structure in which the upper looper guide 6 is fixed to the bed portion B as in the related art, the only practical means for adjusting of two intervals, i.e., the interval between the upper looper 3 and the lower looper 2 and the interval between the upper looper 3 and the needle 1, is to move the upper looper swinging arm 52 in the axial direction of the upper looper driving shaft 51. Therefore, it is practically impossible to accurately adjust both of the intervals. Further, a complicated work is required to adjust both of the intervals.

However, according to the configuration of the exemplary embodiment, the holding portion 64 of the upper looper guide 6 can be moved in the cloth feeding direction, i.e., the front-and-rear direction along the axis of the upper looper driving shaft 51. Therefore, by moving the upper looper guide 6 and the upper looper swinging arm 52, it is possible to adjust the respective intervals between the upper looper 3, the lower 2 and the needle 1 reliably and easily.

For example, the respective intervals are adjusted in the following manner. Firstly, the upper looper swinging arm 52 is operated to move in the axial direction of the upper looper driving shaft 51, i.e., along the cloth feeding direction, in order to adjust the interval between the upper looper 3 and the needle 1 (or the moving path n). Thereafter, the holding portion 64 of the upper looper guide 6 is moved in the axial direction of the axis portion 64*b*, i.e., along the cloth feeding direction, in order to adjust the interval between the upper looper 3 and the lower looper 2 while keeping the interval between the upper looper 3 and the needle 1 (or the moving path n). During this adjustment, the upper looper swinging arm 52 is still movable in the axial direction of the upper looper driving shaft 51 to allow the movement of the holding portion 64 in the axial direction of the axis portion 64*b*.

As described above, the two intervals, i.e., the interval between the upper looper 3 and the lower looper and the interval between the upper looper 3 and the needle 1, are adjusted by means of two adjusting mechanisms. Therefore, it is possible to accurately adjust both of the intervals.

[Stitching Operation]

In order to perform the overlock stitching, first of all, the lower looper driving device 4 rightwardly moves the lower looper 2 below the throat plate synchronously with the downward movement of the needle 1, whereby the lower looper 2 passes through the rear side of the moving path n of the needle 1 and inserts the loop of the lower looper thread into the loop of the needle thread on the needle 1.

When the needle 1 is moved upward, the upper looper driving device 5 starts to move the upper looper 3. The upper looper 3 firstly passes through the rear side of the lower looper 2 to insert the tip portion thereof into the loop of the lower looper thread. The upper looper 3 further moves upward and forward toward the left, and reaches the front side of the moving path n of the needle 1 above the cloth on the throat plate, thereby causing the needle 1 to move through the loop of the upper looper thread in the subsequent downward movements. The overlock stitches are formed by repeating this series of movements.

According to the upper looper driving device 5 of the exemplary embodiment, when the upper looper swinging arm 52 is moved in the cloth feeding direction, i.e., in the axial direction of the upper looper driving shaft 51 in order to adjust the interval between the upper looper 3 and the lower looper 2, the upper looper holder 54 rotatably coupled to the upper looper swinging arm 52 is also moved so that the position of the upper looper 3 with respect to the needle 1 also changes.

However, because the upper looper guide 6 is fixed to the bed portion B such that the position of the upper looper guide 6 is adjustable in the cloth feeding direction, it is possible to offset positional shift of the upper looper 3 with respect to the needle 1, which is caused by the movement of the upper looper swinging arm 52 in the cloth feeding direction, by moving the upper looper guide 6.

Accordingly, it is possible to adjust the interval between the upper looper 3 and the lower looper 2 while maintaining a positional relationship between the upper looper 3 and the needle 1. Thus, it is possible to easily and accurately adjust the position of the upper looper 3 with respect to the lower looper 2 and the needle 1.

Further, according to the upper looper driving device 5 of the exemplary embodiment, the upper looper holder 54 is inserted through the spherical bearing 63 which is rotatably held by the holding portion 64. Therefore, the upper looper holder 54 can be moved in any directions. Furthermore, the fixable bearing 61 can be moved in the cloth feeding direction and cab be fixed, with the setscrew 62, to the bed portion B at a desired position.

Accordingly, it is possible to enhance a degree of freedom of the adjustment of the attaching position of the upper looper guide 6 with respect to the bed portion B which is carried out in accordance with the movement of the upper looper swinging arm 52.

While an exemplary embodiment of the present invention have been described above, those skilled in the art will understand that various changes and modifications may be made therein without departing from the spirit and scope of the present invention. It is aimed, therefore, to cover in the appended claims all such changes and modifications falling within the true spirit and scope of the present invention.

For example, the coupling point of the upper looper holder 54 is not restricted to the coupling point J of the exemplary embodiment. In other words, the coupling point may be set at any portion of the upper looper holder 54 in so far as a similar reciprocating movement of the upper looper 3 between two points can be obtained. In such a case, depending on the position of the coupling point, positions between which the upper looper holder 54 reciprocates change from the two position in the exemplary embodiment. Therefore, it is necessary to provide an operating mechanism operable to move the upper looper holder 54 between the corresponding two positions.

Further, although the position of the upper looper guide 6 is manually adjusted in the exemplary embodiment, some kind of a driving source, such as an air cylinder, may be provided to adjust the position of the upper looper guide 6.

What is claimed is:

1. A device for driving an upper looper of a sewing machine, the device comprising:

an upper looper driving shaft provided so as to be rotatable around an axis thereof;

an upper looper holder comprising an upper end portion at which the upper looper is held;

an upper looper swinging arm comprising one end portion supported by the upper looper driving shaft such that a position of the upper looper swinging arm with respect to the upper looper driving shaft is adjustable along an axial direction of the upper looper driving shaft, and the other end portion to which the upper looper holder is rotatably coupled; and an upper looper guide holding an intermediate portion of the upper looper holder such that the upper looper holder is slidable with respect to the upper looper guide, wherein the upper looper guide is supported by a frame of the sewing machine such that a position of the upper looper guide with respect to the frame is adjustable along a direction parallel to the axial direction of the upper looper driving shaft, and wherein the axial direction of the upper looper driving shaft is substantially parallel to a direction in which a cloth is fed during a stitching work with the sewing machine.

2. The device according to claim 1, wherein the upper looper guide comprises:

a fixable bearing inserted through the frame so as to be movable in the direction parallel to the axial direction of the upper looper driving shaft;

a fixing member operable to fix the fixable bearing to the frame;

a spherical bearing through which the upper looper holder is inserted such that the upper looper holder is movable in all directions; and a holding portion rotatably holding the spherical bearing, the holding portion being rotatably supported by the fixable bearing.

3. A sewing machine comprising:

a frame;

an upper looper; and an upper looper driving device, wherein the upper looper driving device comprises;

an upper looper driving shaft provided so as to be rotatable around an axis thereof;

an upper looper holder comprising an upper end portion at which the upper looper is held;

an upper looper swinging am comprising one end portion supported by the upper looper driving shaft such that a position of the upper looper swinging arm with respect to the upper looper driving shaft is adjustable along an axial direction of the upper looper driving shaft, and the other end portion to which the upper looper holder is rotatably coupled; and an upper looper guide holding an intermediate portion of the upper looper holder such that the upper looper holder is slidable with respect to the upper looper guide, wherein the upper looper guide is supported by the frame such that a position of the upper looper guide with respect to the frame is adjustable along a direction parallel to the axial direction of the upper looper driving shaft, and wherein the axial direction of the upper looper driving shaft is substantially parallel to a direction in which a cloth is fed during a stitching work with the sewing machine.

4. The sewing machine according to claim 3, wherein the upper looper guide comprises:

a fixable bearing inserted through the frame so as to be movable in the direction parallel to the axial direction of the upper looper driving shaft;

a fixing member operable to fix the fixable bearing to the frame;

a spherical bearing through which the upper looper holder is inserted such that the upper looper holder is movable in all directions; and a holding portion rotatably holding the spherical bearing, the holding portion being rotatably supported by the fixable bearing.

* * * * *